US007587916B2

(12) United States Patent
Rizzetto

(10) Patent No.: US 7,587,916 B2
(45) **Date of Patent: *Sep. 15, 2009**

(54) CLOTHES WASHING MACHINE WITH AN INTEGRATED ARRANGEMENT OF WATER DISPENSERS

(75) Inventor: Pietro Rizzetto, S. Stino di Livenza (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 669 days.

This patent is subject to a terminal disclaimer.

(21) Appl. No.: 11/106,072

(22) Filed: Apr. 14, 2005

(65) Prior Publication Data

US 2005/0252251 A1 Nov. 17, 2005

(30) Foreign Application Priority Data

May 13, 2004 (EP) ..... 04102080

(51) Int. Cl.
*D06F 39/08* (2006.01)

(52) U.S. Cl. ..... 68/17 R

(58) Field of Classification Search ..... 68/17 R
See application file for complete search history.

(56) References Cited

U.S. PATENT DOCUMENTS 3,044,285 A * 7/1962 Koplin ..... 68/12.18
3,086,379 A * 4/1963 Plante ..... 68/12.13
3,747,645 A * 7/1973 Holster et al. ..... 137/838
3,949,576 A * 4/1976 Waugh et al. ..... 68/12.18
4,043,158 A * 8/1977 Bochan ..... 68/17 R
4,111,011 A * 9/1978 Waugh ..... 68/17 R
4,905,485 A * 3/1990 Fornasari ..... 68/12.11
4,960,139 A * 10/1990 Rizzetto ..... 137/625.46
5,884,506 A * 3/1999 Blauert et al. ..... 68/17 R

FOREIGN PATENT DOCUMENTS

EP 0 719 884 7/1996
IT PN2003A000034 5/2003

* cited by examiner

*Primary Examiner*—Frankie L Stinson
*Assistant Examiner*—Samuel A Waldbaum
(74) *Attorney, Agent, or Firm*—Pearne & Gordon LLP

(57) ABSTRACT

Clothes washing machine comprising: a common water-distribution manifold, a plurality of electromagnetic valves provided downstream of said water-distribution manifold and connected on respective outlet conduits, a plurality of chambers supplied via a respective one of said outlet conduits, a further chamber supplied with a water flow generated by the intersection of said outlet conduits, wherein a nozzle lodged in a bellows is supplied with a water flow in a fifth conduit having a respective air-gap and starting upstream of said intersection; the initial portions of said outlet conduits and of the fifth conduit, upstream the air-gaps, are a single enbloc body, which is connected to the assembly of the water flat conveyors and of said fifth conduit downstream the air-gaps.

3 Claims, 5 Drawing Sheets

CLOTHES WASHING MACHINE WITH AN INTEGRATED ARRANGEMENT OF WATER DISPENSERS

Figure 1:
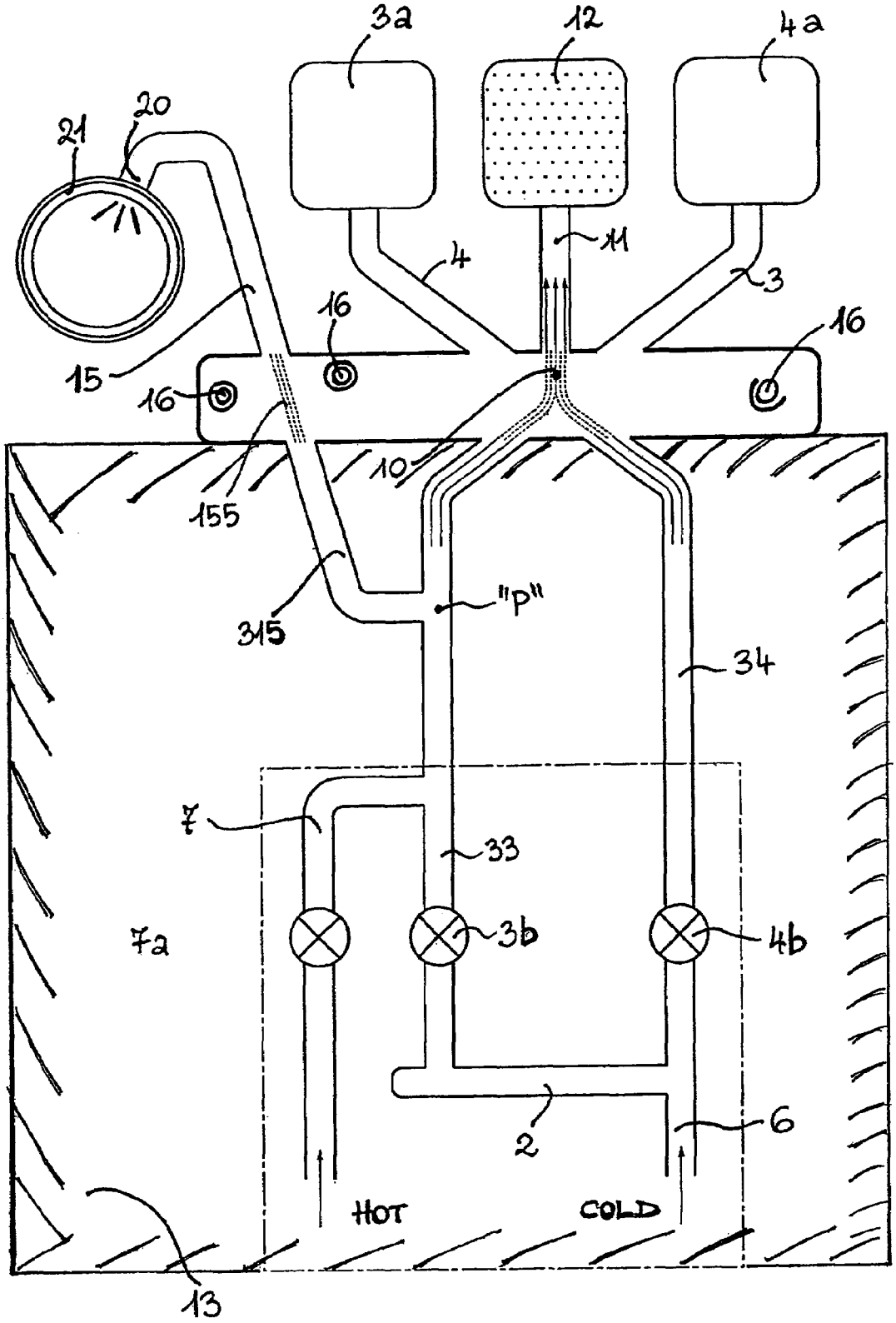

The present invention refers to an improved kind of clothes washing machine, preferably of the type for use in households, which is capable of operating in an improved and more advantageous manner as far as control of the water flows being let into the machine is concerned, and particularly is provided with an additional water flow coming from the bellows and directed with appreciable energy towards the inner portion of the laundry contained into the tub.

Although reference to a regular, simple-type clothes washing machine will be made throughout the following description, it shall be appreciated that what is set forth below may similarly be applied to and, therefore, be suitable for combined clothes washing and drying machines.

Clothes washing machines are known in the art, which operate by using not only the home water delivery system, which usually delivers cold water, but also an additional water delivery system specially provided in the home to supply hot water. Quite popular in the US market, in particular, is a kind of clothes washing machine for residential use, and even for use in such communities as apartment buildings, boarding schools, colleges and the like, which are not provided with a heating element of their own to autonomously heat up the water flowing in from the public water utility system and used for washing, but are on the contrary arranged to directly take in and use the hot water delivered by said additional hot-water supply system.

This construction and circuit configuration of the above-described arrangement has turned out as being particularly easy to implement, as well as reliable in its operation. However, it is rather expensive owing to both the presence of as many as five distinct electromagnetic valves, each one of which must be connected independently. All this eventually translates into a rather high overall final cost of the water supply and distribution assembly, which turns out as being by all means undesired in the particular case of a kind of appliance such as a clothes washing machine, which is generally required to be as low and effective in costs as possible.

In order to overcome this drawback, from the Italian Patent Application PN2003A 000034 an arrangement of three electrovalves (3*b*, 4*b* and 7*b*) is known that is associated to a common distribution manifold, and which downstream said electrovalves is combined to a plurality of separate air-gaps together with a common intersection (15) of the water flows coming from two of said electrovalves.

Such a solution is experienced to be particularly disadvantageous, when implemented with the known techniques, as said separate air-gaps, and said intersection and the components to them associated are both complicated in their operation and burdensome in the construction and in the materials that have to be used.

Moreover a further drawback has to be recorded: as the present invention refers to the kind of machines provided with a supplementary water jet coming from the bellows and directed into the laundry to be washed, the problem consists in the implementation of a branch-duct, selectively operable, into which a water flow with a still high pressure can be conveyed, in a simple and convenient way.

From EP 0719884B1 it is known to make up a branch-duct for a water flow directed, downstream the air-gap, towards other operating devices of the machine; however such a solution is not effective from the operating point of view as said duct branches out exactly from a portion of the water dispenser that usually is placed over the chambers containing the products for use in the washing process; the consequent pressure loss that is transferred also to the water flow inside said branch is so remarkable to compromise a proper mass-flow of the water jet coming from the bellows and has to penetrate into the laundry load.

It would therefore be desirable, and it is actually a main object of the present invention, to provide a clothes washing machine adapted to be supplied with both cold and hot water and provided with arrangements that are capable of distributing the individual flows of said hot and cold water to flow into the various chambers containing the washing and rinsing aids according to an optimised use of the electrovalves, provided with a branch duct directing the respective water flow with a proper pressure to a nozzle lodged into the bellows, and wherein the water dispensers, the relevant air-gaps and the intersection of the water flows are made in a simply and easy way and at a significantly low level costs.

According to the present invention, this aim is reached, along with further ones that will be apparent from the following description, in a clothes washing machine incorporating the features as recited in the appended claims.

Figure 2:
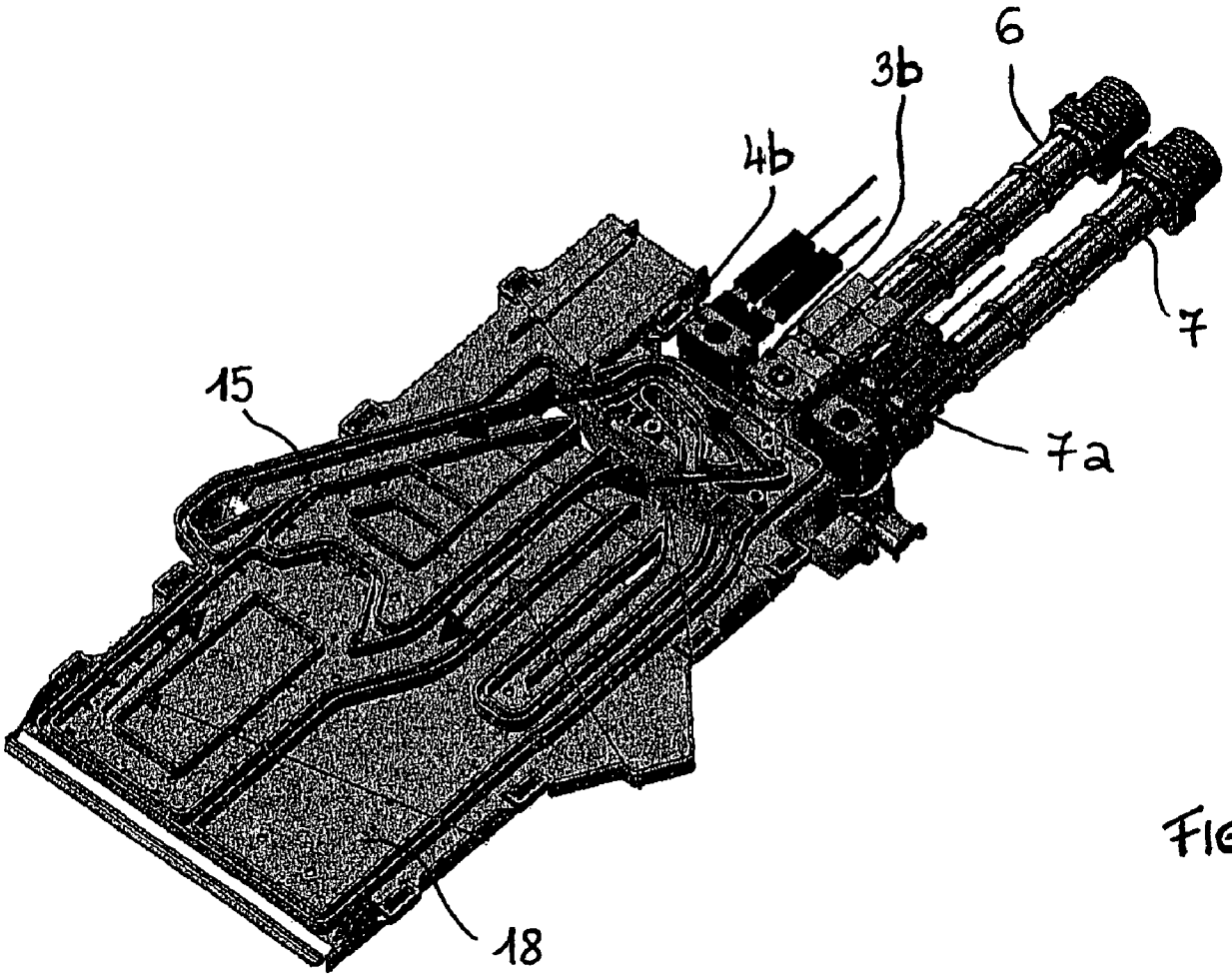
Figure 3:
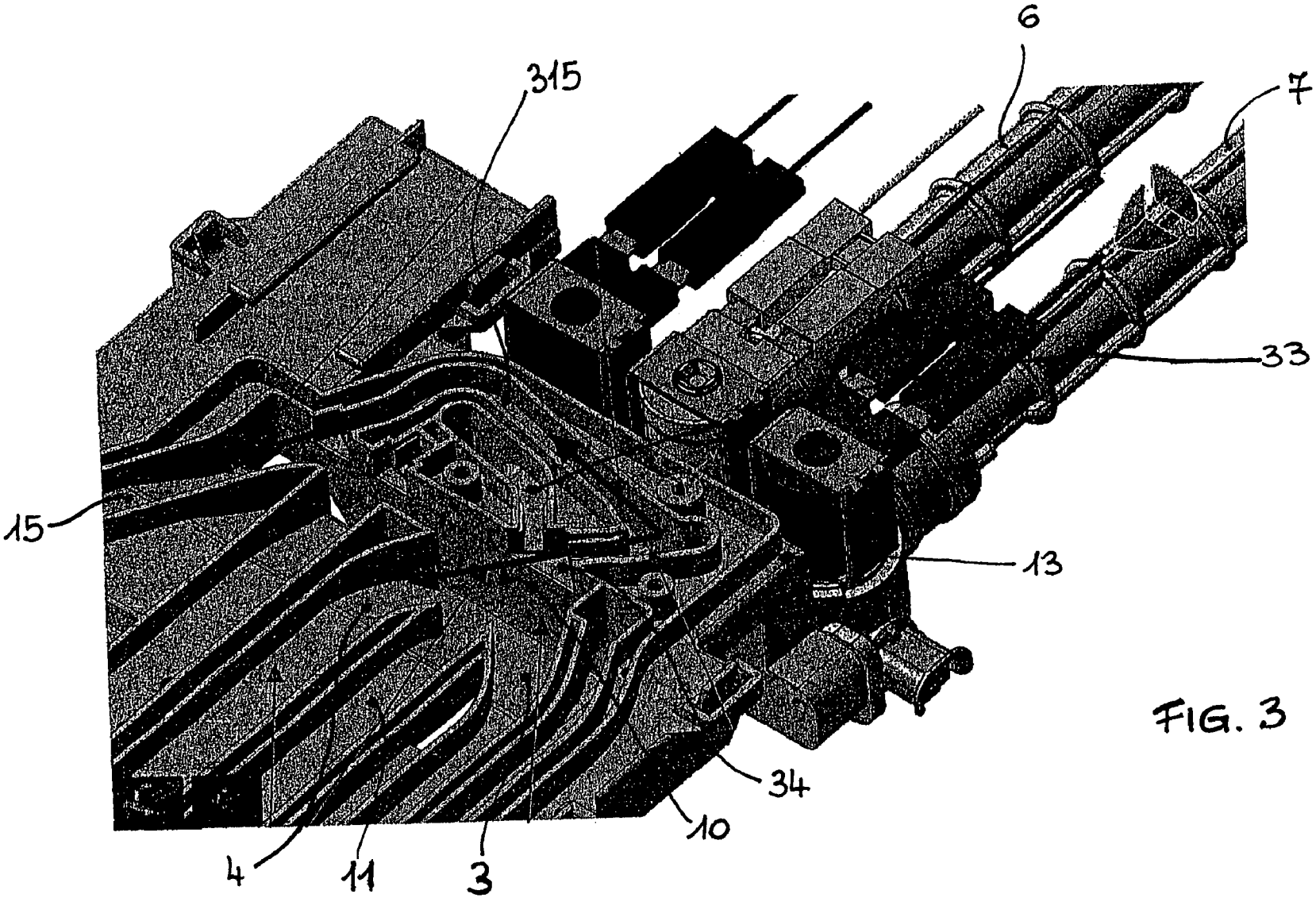
Figure 4:
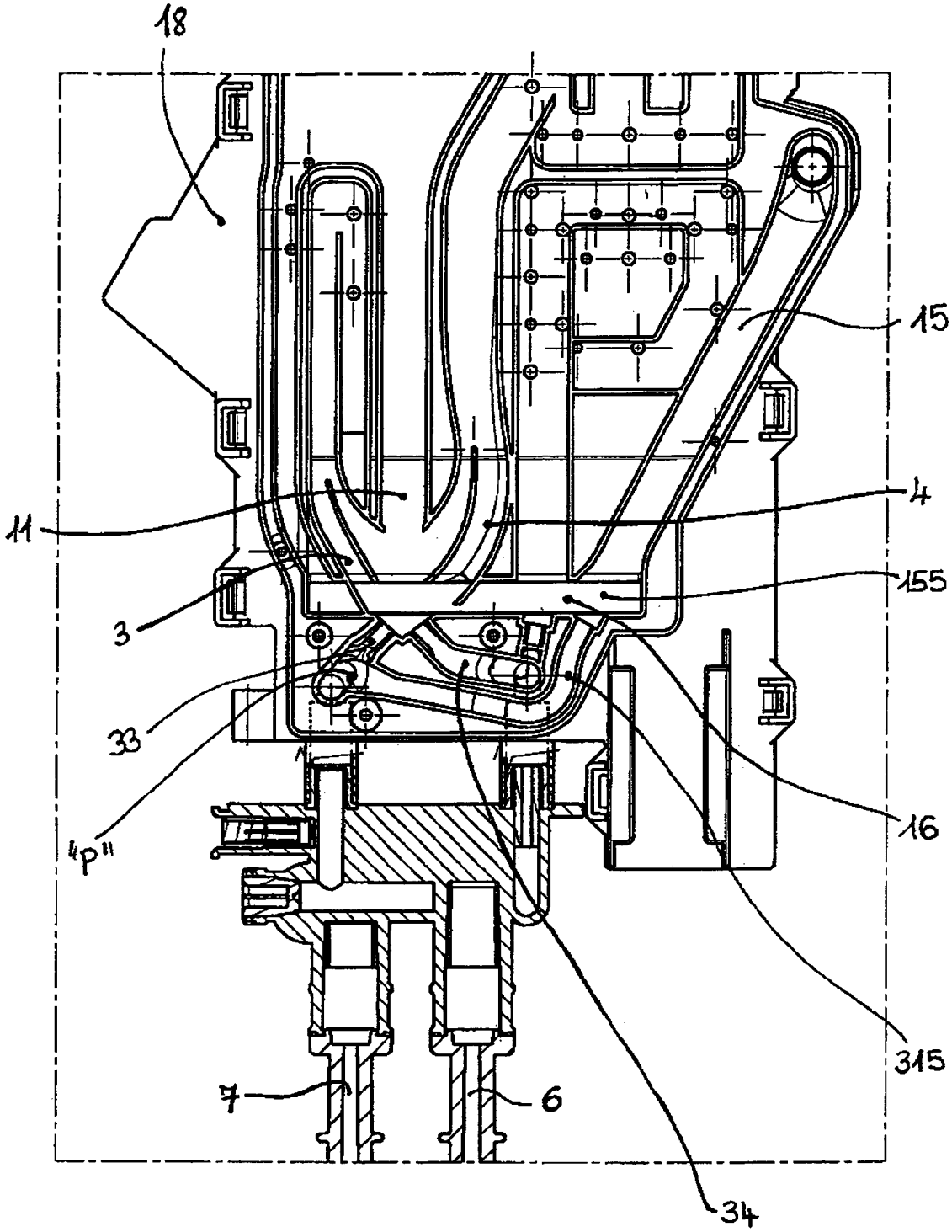
Figure 5:
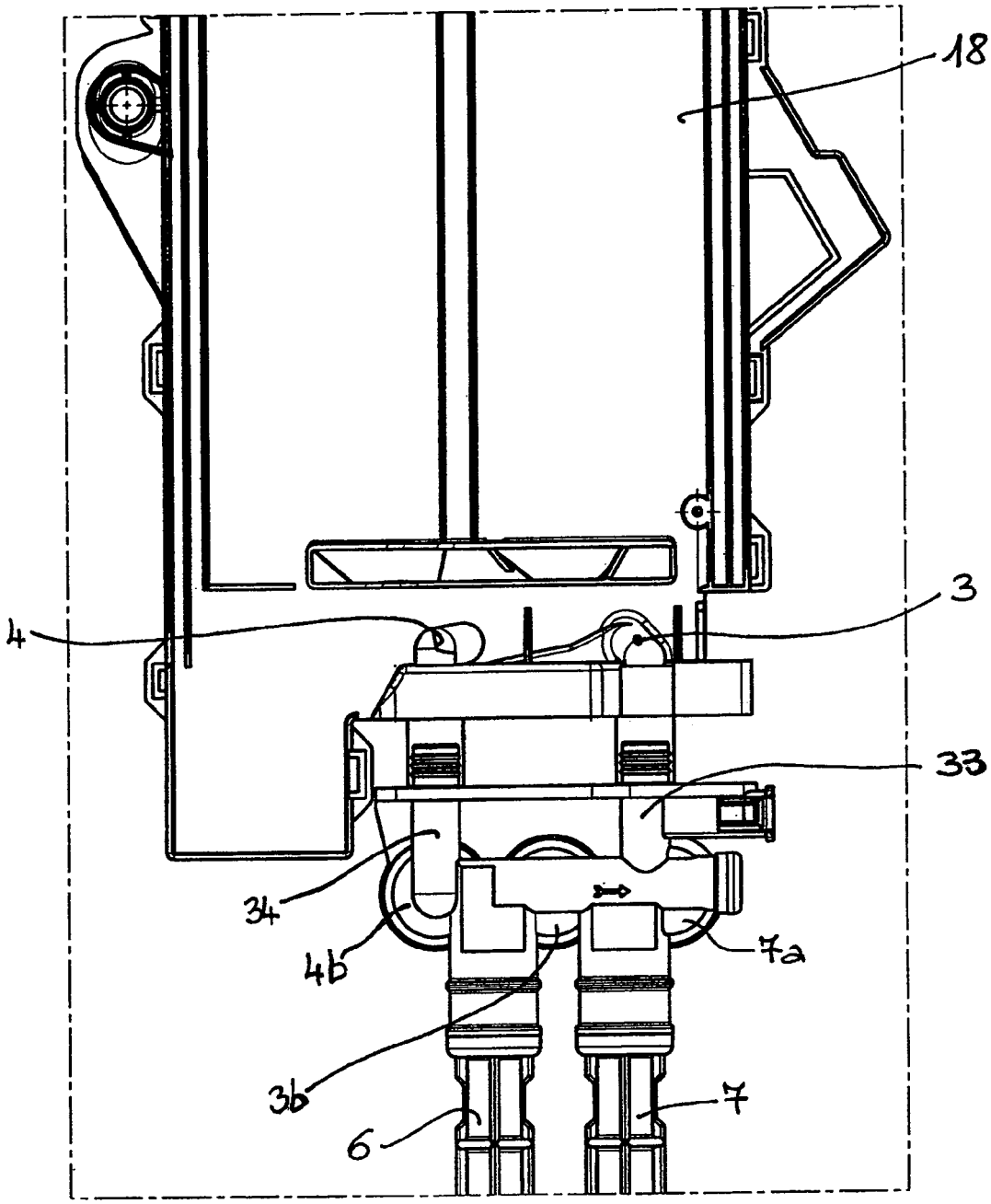

Anyway, features and advantages of the present invention will be more readily understood from the description that is given below by way of non-limiting example with reference to the accompanying drawings, in which:

FIG. 1 is a general symbolical, schematic view of water supply control means in a washing machine according to the present invention;

FIG. 2 is a perspective view of a preferred embodiment of the water supply control means according to the present invention, FIG. 3 is an enlargement of a portion of water control means illustrated in FIG. 2, FIG. 4 is a symbolic section view of the water control means of FIG. 2, from a section plane parallel to the conveyor and cutting the hot- and cold water mains conduits, and FIG. 5 is a rear view of a portion of the water control means illustrated in FIG. 2, With reference to FIG. 1, in a clothes washing machine according to the present invention there is provided a drum adapted to hold the clothes to be washed, not shown, a common water distribution manifold 2, connected to a mains pipe 6, a plurality of outlet conduits 3, 4, leading into two chambers 3*a*, 4*a*, which contain products for use in the washing process and all other processes associated therewith, said outlet conduits comprising two respective electromagnetic valves 3*b*, 4*b*, that are adapted to control the flow of water from said common water distribution manifold 2 to each one of said respective outlet conduits 3, 4.

At this point it has to be strongly stressed that the invention applies to water dispensers also wherein further electrovalves are placed, which control respective water flows into respective chambers, as generally described in the cited Italian Patent Appl. No. PN2003A 000034; however for the sake of simplicity the instant description refers the type of water dispenser provided with only two outlet conduits, controlled by respective electrovalves, that intersect in a specified point to create a further outlet conduit supplying a respective chamber, and a third outlet conduit 7, normally used to admit the hot water only, controlled by a respective electrovalve 7*b*, and that leads in one of said outlet conduits 3 or 4.

According to the invention, said two outlet conduits 3 and 4 do come directly from the respective electrovalves and are oriented to a common intersection point 10, wherein obviously their physical continuity will end to allow the respective water flows to impinge each other, and consequently to form a new water flow that enters into a fourth outlet conduit 11 bound to a respective chamber 12.

Said intersection and interruption point of the outlet conduits 3 and 4 is used also as the air-gap of the same two conduits 3 and 4, and so their air-gaps will coincide with the air-gap of said fourth conduit 11, that obviously exists only downstream the same intersection 10.

Such a coincidence between the air-gaps of the three conduits 3, 4 and 11 and the intersection point 10 of two of them does represent a main aspect of the invention.

It is implemented through a single body 13 that in the same time:

contains the portions 33 and 34 of said two conduits 3 and 4 upstream the respective air-gaps, delimits said air-gaps on the electrovalves side, and realises a supporting element of said electrovalves 3*b*, 4*b* and 7*b*, or of said manifold 2 bearing said valves, wherefrom said outled conduits 3 and 4 are leaving.

Only for example, said structure has been described in the cited It. Pat. Appl., as a "common distribution manifold 2".

According to a main aspect of the invention, a fifth outlet conduit 15 branches out from a point "P" of said outlet conduit 3 downstream its connection with said third conduit 7, as shown in FIGS. 1, 2 and 4; said fourth conduit 15 gets over a related air-gap 15S, and directs towards a nozzle 20 lodged in the bellows 21.

In its initial portion 315 said fifth conduit 15 is made enbloc with said single body 13, and according a further advantageous aspect of the invention, said single body 13 is delimited by a "trench" 16 which works both as an air-gap and related intersection point for said two outlet conduits 3 and 4, and as an air-gap also for said fifth conduit 15, 315.

According to the prior art, the chambers containing the substances to be used in the washing process, are provided with respective water flows raining down from respective flat conveyers made enbloc and that comprise a common bottom surface, duly provided with holes to let the water down, and delimiting downwards the plurality of channels placed above said chambers.

Profitably, the end portion of said conduit 15 is made enbloc with said flat conveyers, so to become an integer part of these, as clearly shown in the FIGS. 1 to 3.

As a last improvement, and considered that:

said flat conveyer is made as an integrated enbloc, said single body 13 is also made enbloc, and said trench 16, working as an air-gap both for these conduits 3 and 4, as well as for said fifth outlet conduit 15, is a separation means between said single body 13 and said flat conveyer, (comprising said fifth conduit 15)

it comes out that, from a productive point of view, it is much more effective and convenient to realise both said flat conveyer and said single body 13 as a fully integrated enbloc 18, wherein said trench 16 is made up with a simple and empty separation portion between the two facing portions of said fully integrated enbloc 18.

From a productive point of view said fully integrated enbloc 18 can be made by a single injection moulded item, to which the valve assembly and said common distribution manifold 2 are then associated.

According to a preferred embodiment of the present invention, a cold-water inlet conduit 6 is provided to debouch into said common water distribution manifold 2.

Furthermore, a hot water inlet conduit 7 is provided to connect the hot-water supply system (not shown) to one 3 of said outlet conduits downstream of the respective electromagnetic valve 3*b*.

The invention claimed is:

1. Clothes washing machine comprising:

a drum for holding the clothes to be washed, a bellows (21), a common water-distribution manifold (2), a plurality of electromagnetic valves (3*b*, 4*b*) arranged downstream of said water-distribution manifold and connected on a respective inlet side thereof to said common water-distribution manifold (2), a plurality of outlet conduits (3, 4) provided at delivery ports of respective ones of said electromagnetic valves, a respective plurality of chambers (3*a*, 4*a*) provided to contain washing products, rinsing aids and similar substances, each one of said chambers being supplied via a respective one of said outlet conduits (3, 4), a cold-water inlet conduit (6) directly connecting a low-temperature water supply system to said water-distribution manifold (2), a hot-water inlet conduit (7) connecting a high-temperature water supply system to a pre-determined one (3) of said outlet conduits downstream of the respective electromagnetic valve (3*b*), a further electromagnetic valve (7*b*) installed in said hot-water inlet conduit (7) upstream of the point at which the latter connects with said pre-determined outlet conduit (3), a further chamber (12) that is supplied with a respective water flow directed from a fourth outlet conduit (11) and generated by the intersection (10) and physical impinging between the two water-flows in said outlet conduits (3, 4), characterised in that:

said bellows (21) comprises nozzle means (20) to direct a jet of water coming from a fifth conduit (15) derived from a point (P) in one (3) of said outlet conduits, downstream the connection with said hot-water inlet conduit (7), but upstream said intersection (10) between said outlet conduits (3, 4), said fifth conduit (15) is supplied with a respective air-gap (15S), the initial portions (33, 34, 315) of said outlet conduits (3, 4) and of said fifth conduit (15) are a single enbloc body (13), which delimitates, on the same side, both the two water flows in the respective outlet conduits (3, 4) before said intersection (10), and said air-gap (15S) of said fifth conduit (15), and said two outlet conduits (3, 4) are directed towards respective flat conveyers made as an enbloc, which comprises the portion of said fifth conduit (15) downstream the respective air-gap (15S).

2. Clothes washing machine according to claim 1, characterised in that between said enbloc flat conveyers and said enbloc body (13) a separation trench (16) is placed, wherein both said intersection point (10) and said air-gap (15S) of said fifth conduit (15) are located.

3. Clothes washing machine according to claims claim 2, characterised in that said single enbloc body (13) and said enbloc flat conveyers are made up as a fully integrated enbloc item (18), and that said separation trench (16) is an empty portion placed internally of said fully integrated enbloc item (18).

* * * * *

UNITED STATES PATENT AND TRADEMARK OFFICE

CERTIFICATE OF CORRECTION

PATENT NO. : 7,587,916 B2
APPLICATION NO. : 11/106072
DATED : September 15, 2009
INVENTOR(S) : Pietro Rizzetto It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1093 days.

Signed and Sealed this

Fourteenth Day of December, 2010

David J. Kappos

David J. Kappos
*Director of the United States Patent and Trademark Office*